United States Patent [19]

Folkertsma

[11] Patent Number: 4,966,210

[45] Date of Patent: Oct. 30, 1990

[54] WALLET WITH DETACHABLE BILLFOLD

[76] Inventor: John M. Folkertsma, 8653 Conservation Rd., NE., Ada, Mich. 49301

[21] Appl. No.: 457,519

[22] Filed: Dec. 27, 1989

[51] Int. Cl.[5] ..... A45C 1/06; A45C 11/18; A45C 13/02

[52] U.S. Cl. ..... 150/138; 150/147; 150/148

[58] Field of Search ..... 150/106, 132, 134, 138, 150/143, 131, 113, 147, 148, 135, 136

[56] References Cited

U.S. PATENT DOCUMENTS

| | | | |
|---|---|---|---|
| 629,822 | 8/1899 | Scheuer | 150/138 |
| 1,310,621 | 7/1919 | Holland . | |
| 1,585,051 | 5/1926 | Skoglund . | |
| 2,207,135 | 7/1940 | Trollen | 150/138 |
| 2,300,144 | 10/1942 | Buxton | 150/35 |
| 2,335,051 | 11/1943 | Gardner | 150/136 |
| 2,350,503 | 6/1944 | Gardner | 150/143 X |
| 2,368,040 | 1/1945 | Pitar | 150/38 |
| 2,407,964 | 9/1946 | Post | 150/143 X |
| 2,451,122 | 10/1948 | Sherwood | 150/138 |
| 2,577,674 | 12/1951 | Broughton | 150/143 X |
| 2,604,134 | 7/1952 | Knee | 150/143 X |
| 2,612,201 | 9/1952 | Lipp | 150/143 X |
| 2,803,281 | 8/1957 | Sutton | 150/138 |
| 2,982,322 | 5/1961 | Seitz | 150/39 |
| 3,165,135 | 1/1965 | Mintzes et al. | 150/138 X |
| 3,929,177 | 12/1975 | Reis | 150/138 X |
| 4,010,787 | 3/1977 | Traugott et al. | 150/35 |
| 4,105,057 | 8/1978 | Baumann et al. | 150/35 |
| 4,705,086 | 11/1987 | O'Neill | 150/134 |

FOREIGN PATENT DOCUMENTS

| | | | |
|---|---|---|---|
| 2535954 | 5/1984 | France | 150/138 |

*Primary Examiner*—Sue A. Weaver

*Attorney, Agent, or Firm*—Price, Heneveld, Cooper, DeWitt & Litton

[57] ABSTRACT

A combination wallet and billfold includes a main wallet defined by a pair of generally rectangular members joined along their peripheral edges. A billfold is removably secured to an inner surface or face of the main wallet. A first strap engages the billfold along a bottom edge. A second strap or flap joined to the wallet is foldable within the billfold currency pocket. The second strap is fastened to an inner surface of the billfold.

22 Claims, 5 Drawing Sheets

WALLET WITH DETACHABLE BILLFOLD

BACKGROUND OF THE INVENTION

The present invention relates to wallets and more particularly to a combination wallet and detachable billfold.

Heretofore various combinations of wallets, billfolds and pocketbooks have been proposed. Wallets adapted to carry unfolded currency, pictures and a plurality of credit cards are relatively large. They are primarily adapted to be carried in a coat pocket or in a purse. Such a wallet is larger in size than a pants or trousers pocket. When the user is not wearing a coat or carrying a purse, credit cards, currency and the like have to be removed and carried loose if a coat pocket wallet is the only one used. Another alternative is to transfer such to a separate pocket wallet or billfold. An example of a wallet adapted for carrying in a coat pocket may be found in U.S. Pat. No. 4,010,787 entitled Wallet and issued on Mar. 8, 1977 to Traugott. As shown therein, the wallet includes a pair of rectangular planar members which may be folded to a face to face relationship. A plurality of straps are included to store currency in a flat, unfolded configuration. In addition, the wallet defines a plurality of slit pockets adapted to accommodate credit cards and the like.

In an attempt for increased flexibility, it has been proposed to provide a pocketbook or wallet with a removable section. Such would permit the user to remove a section containing currency, for example, from the wallet when a coat or the like is not worn or a purse is not carried. The removable section can the be carried in a pants pocket or in a smaller purse. Prior approaches generally do not retain the aesthetics, dimensions or appearances of conventional, individual coat wallets or pocket billfolds. The combination may be bulky and access to individual elements without separating them may be limited.

An example of one proposal may be found in U.S. Pat. No. 2,300,144 entitled Flexible Pocket Receptacle and issued on Oct. 27, 1942 to Buxton et al. The wallet shown therein includes a main wallet having an outer wall with a central, vertical fold line which divides the wall into two portions which may be folded upon each other. A bill compartment for the wallet is defined by a separable element or billfold which is removable from the main body of the wallet. The separable element is positioned within a separate compartment defined by the main wallet. The pockets of the billfold can only be accessed by removing it from the compartment.

A need exists for a combination wallet and pocket billfold which provides ready access to the billfold when positioned in the wallet, which firmly and securely retains the billfold within the wallet, which is relatively easy to manufacture, and which retains the aesthetics, dimensions and appearance of a conventional coat wallet or pocket billfold.

SUMMARY OF THE INVENTION

In accordance with the present invention, the aforementioned needs are substantially fulfilled. Essentially, a combination wallet and billfold is provided which includes a main wallet having inner and outer surface and a vertical center fold line. A separate billfold having an elongated currency pocket is detachably secured to an inner surface of the main wallet. Ready access to the billfold pocket is allowed when the billfold is secured to the wallet. In narrower aspects of the invention, the billfold is secured to the wallet along an outer edge and between inside and outside layers which define the currency pocket.

The present invention provides a combination billfold and wallet which firmly secures the billfold in the wallet, permits ready access to all pockets or compartments defined by the billfold and which maximizes the size of the billfold which will be retained in the wallet.

DETAILED DESCRIPTION OF THE PREFERRED EMBODIMENTS

Figure 1:
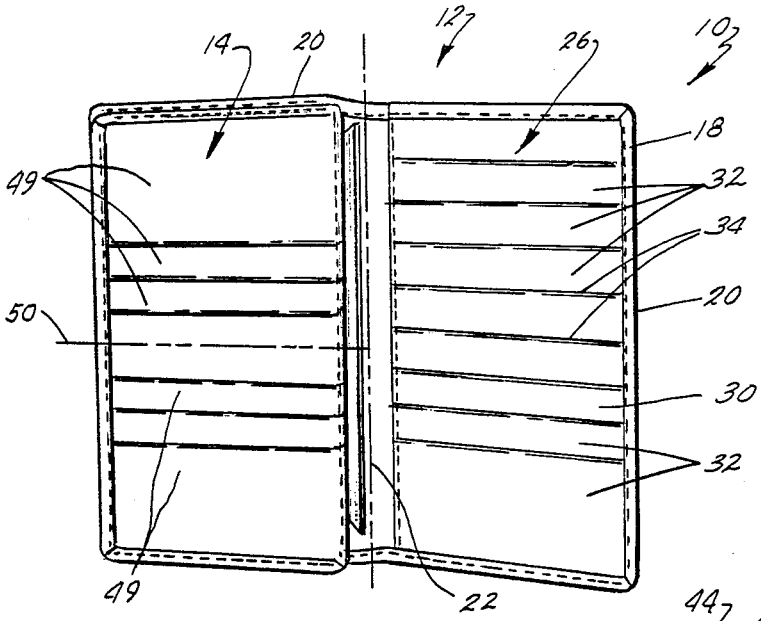
FIG. 1 is a perspective view of a wallet in accordance with the present invention opened so that the inner faces of the wallet are shown.

A preferred embodiment of a combination wallet and billfold in accordance with the present invention is illustrated in FIG. 1 and generally designated by the numeral 10. Article 10 includes a main wallet 12 and a billfold 14. Billfold 14, as discussed in more detail below, is removably secured to wallet 12.

Figure 3:
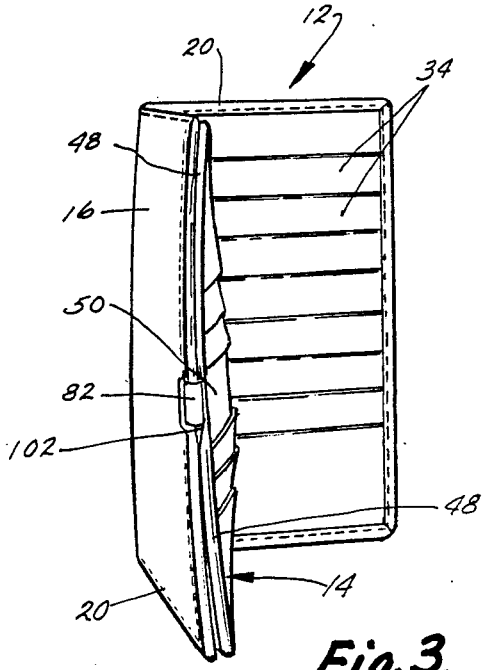
FIG. 3 is a left side perspective view of the wallet.
Figure 4:
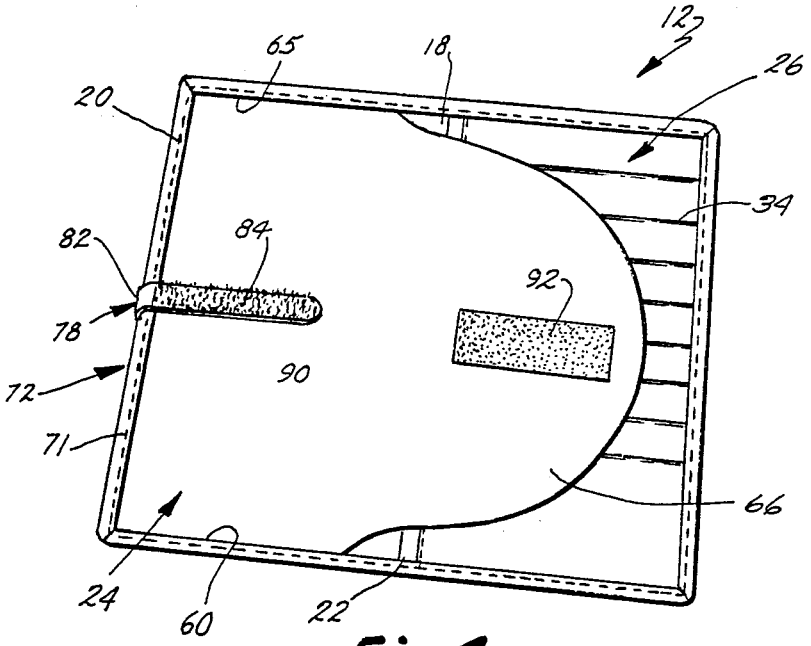
FIG. 4 is a perspective view of the wallet with the billfold removed.
Figure 5:
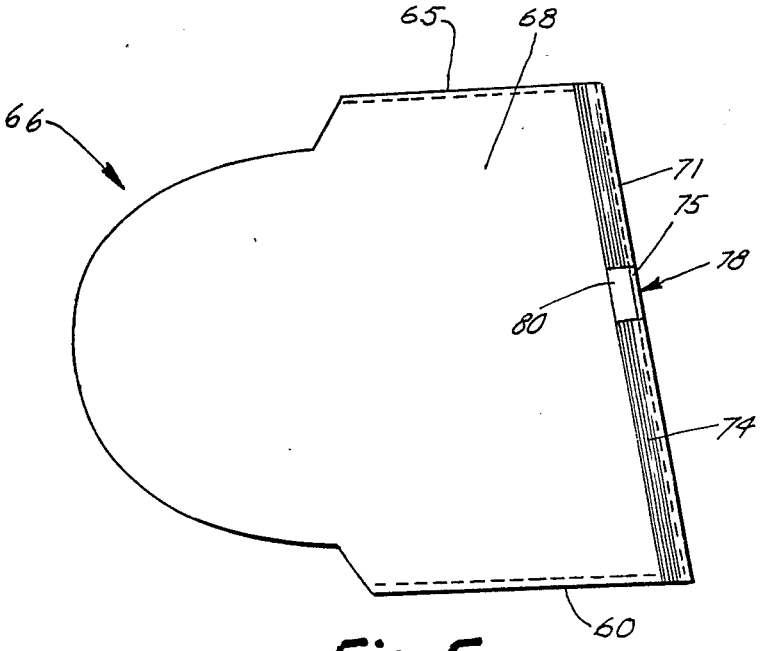
FIG. 5 is a rear, perspective view of a portion of the wallet.
Figure 10:
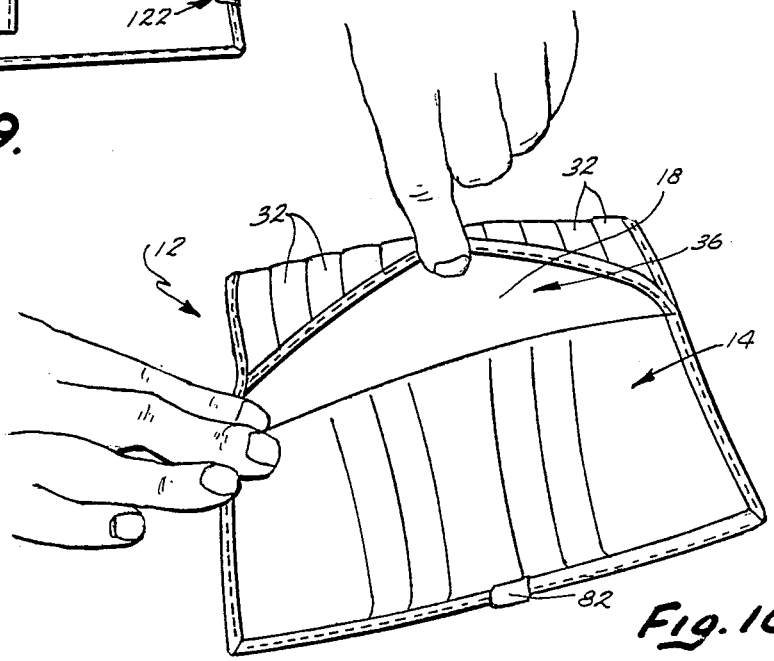
FIG. 10 is a perspective view of the embodiment of FIG. 1 showing an inner pocket defined by the main wallet.

As seen in FIGS. 3, 4 and 5, wallet 12 is formed from an outer, generally rectangular member or piece 16 and an inner, generally rectangular member or piece 18. Pieces 16, 18 are sewn together around their peripheries 20. Pieces 16, 18 define a generally vertical fold line 22. Fold line 22 divides main wallet 12 into halves 24, 26. Halves 24, 26 may be folded towards each other in opposed relationship. Billfold 14 is removably secured to half 24. A pocket means 30 is secured to half 26. Pocket means 30 includes a plurality of individual pocket pieces 32 sewn to the main wallet to define credit card pockets 34. In addition, as shown in FIG. 10, the pocket structure defines an enlarged pocket 36 in cooperation with inner member 18.

Billfold 14 is of a relatively conventional size and shape. The billfold includes an outer, generally rectangular billfold member 40 and an inner, generally rectangular billfold member 42. Members 40, 42 are sewn together along opposed ends or sides 44, 46 and along a bottom edge 48. Additional pocket defining pieces 49 may be sewn to member 40 to define credit card pockets and the like. Members 40, 42 define a fold line 50. In addition, the members have opposed inner surfaces 52, 54 which define an open ended currency pocket 56. Billfold 14, as seen in FIG. 1, is readily accessible when mounted on main wallet 12. The pockets defined by pieces 49 are completely exposed. The open currency pocket 56 may be readily accessed by the user. Pocket 56 will retain currency in an unfolded condition. As seen in FIG. 1, billfold 14 is dimensioned so that it covers substantially the entire surface of half 24 of wallet 12.

A preferred form of the billfold attachment structure is shown in FIGS. 3–5, and 6. A strap or flap 66 is attached to an outer surface of wallet defining member 18. Flap 66 has a base 68 which includes sides 60, 65 and a bottom edge 71. Sides 60, 65 and edge 71 are sewn to wallet member 18 along the periphery of the wallet and at edge 72 thereof. Flap 66 is foldable, therefore, adjacent wallet fold line 22. The flap and member 18 define an elongated pocket.

A reinforcement strip 74 is sewn to base 68 at edge 71 on the side of base 68 which faces member 18. Strip 74 is formed with a cut 75. An elongated strap 78 is slipped through cut 75 and positioned perpendicular to strip 74. Strap 78 is bent to a generally U-shaped configuration and includes a leg portion 80 secured to strip 74 and an elongated leg portion 84. Leg 84 extends across inner surface 24 towards fold line 22. After strip 74 and strap 78 are attached, the base 68 is sewn to member 18, as described above.

Figure 4A:
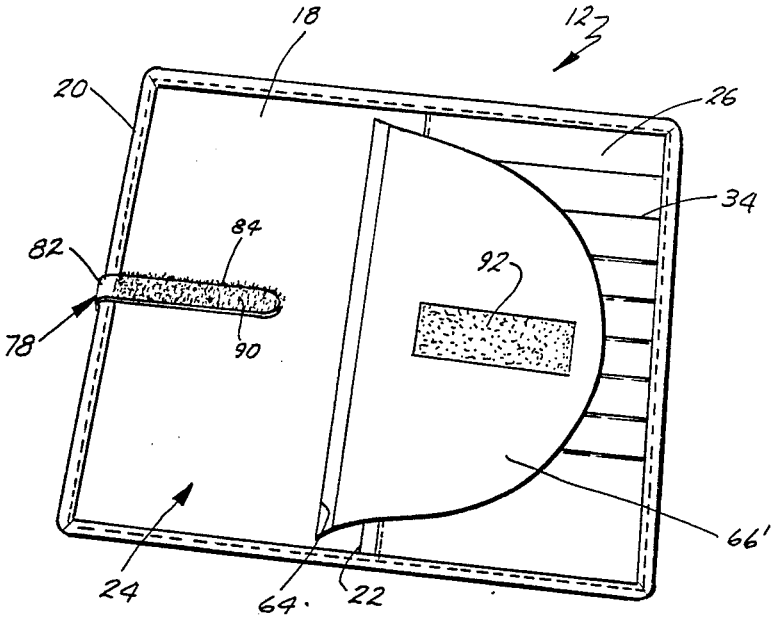
FIG. 4*a* is a perspective view of the wallet with an alternative billfold attachment structure.
Figure 5A:
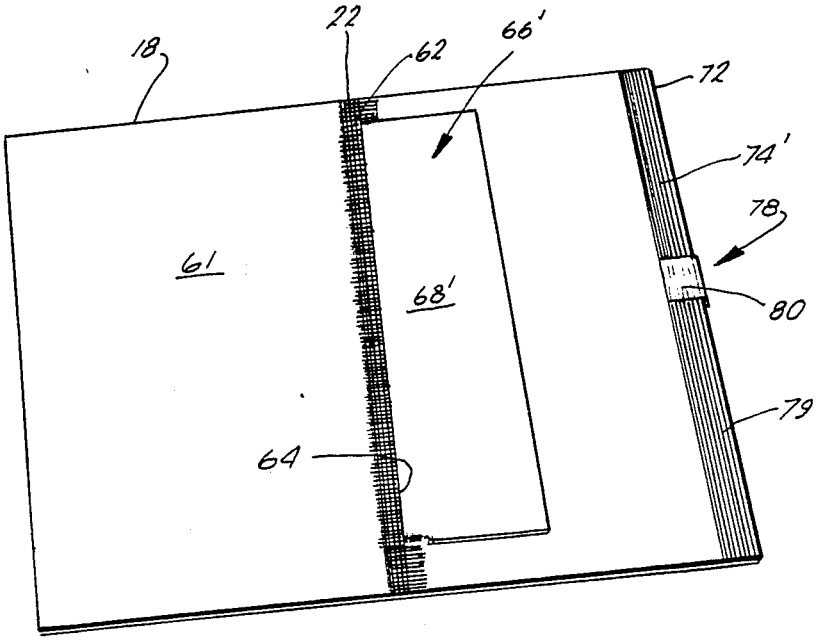
FIG. 5*a* is a rear perspective view of a flap incorporated in the wallet of FIG. 4*a;*

An alternative form of the billfold attachment structure is seen in FIGS. 4*a*and 5*a*. Wallet defining member 18 has an inner surface 61 which faces an inner surface of member 16 (FIG. 5*a*). Member 18 may have a strip of reinforcing material 62 secured adjacent fold line 22 on surface 61. Strip 62, if used, is sewn to member 18 and formed with an elongated slit 64. Base portion 68 of flap 66' may extend through slit 64. Portion 68' may be glued or otherwise fixed to surface 61 of member 18 and sewn to strip 62. The flap extends through slit 64 as shown in FIG. 4. Strip 62 forms a rigid and durable base through and on which flap 66' is connected to main wallet 12.

As shown in FIGS. 4*a* and 5*a*, reinforcement strip 74' may be sewn to edge 79 of member 18. Strip 74' may be defined by a pair of members joined together using an adhesive. Elongated strap 78 may then be secured between the members which form strip 74'.

It is presently preferred that any reinforcement strips used and strap 78 be cut from polyester boning material. Such materials are commercially available at sewing supply outlets. One such material is sold by Selectus, Inc. under the brand name Rigilene. The boning material can be easily shaped by heating it and bending it before or after attachment. The strips can be sewn directly to the wallet elements.

As shown in FIG. 4, a fastener means is secured to flap 66 and leg 84 of strap 78. It is presently preferred that a hook and loop type fastener be used. As shown in FIG. 4, a strip of loop material 90 is glued, sewn or otherwise secured to elongated leg 84. A strip of hook material 92 is glued, sewn or otherwise secured to flap 66.

Figure 2:
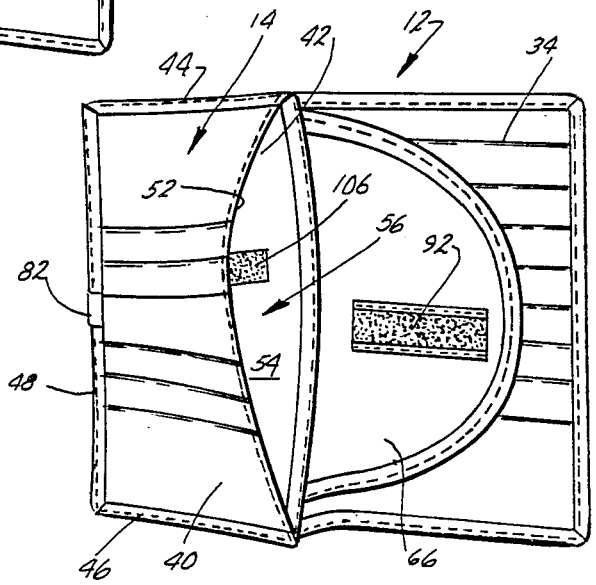
FIG. 2 is a perspective view of the wallet showing the billfold partially removed.
Figure 6:
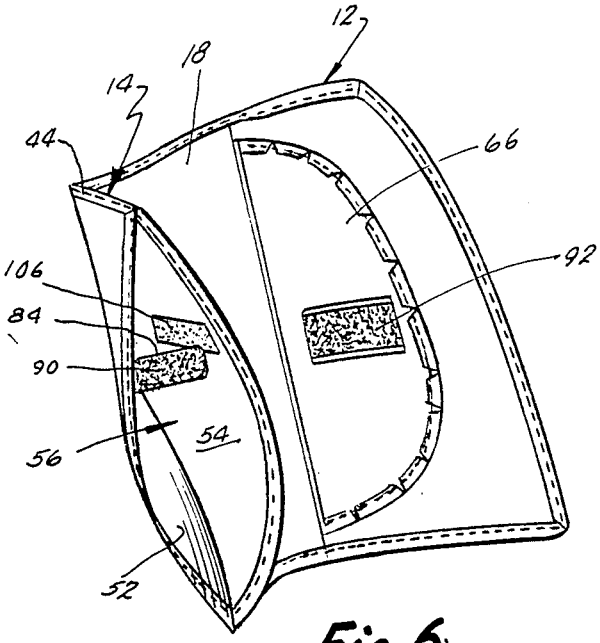
FIG. 6 is a perspective view showing the inner, opposed surfaces of the billfold and the securing straps.

As seen in FIGS. 2, 3 and 6, billfold 14 defines an aperture or opening 102 along bottom edge 48 at fold line 50. The opening 102 is dimensioned to receive leg 84 of strap 78. Base 82 is dimensioned so that billfold member 40 may slip between strap portion 84 and main wallet 12. As seen in FIGS. 2 and 6, when strap portion 84 is inserted through aperture 102, billfold 14 is positionable immediately adjacent the outer lateral edge of the main wallet 12. Strap 66 may then be folded within the compartment or pocket 56 and the hook and loop fastener material interlocks to secure billfold 14 firmly to wallet 12 in a belt like fashion. As seen in FIG. 6, a strip of loop fastener material 106 may be secured to inner surface 52 of pocket 56. Strip 92 on flap 66 is dimensioned to engage both fastener strip 90 and fastener strip 106. The additional fastener strip more securely retains billfold 14 on the wallet. It has been found, however, that billfold 14 may be adequately retained if the hook and loop fastener strips 90, 92, 106 are not used. The flap 66 and strap 78 will hold the wallet. Better retention would be achieved by stiffening flap 66.

Flap 66 has a generally semi-circular shape with the base having a width dimension approximately equal to the length of pocket 56. The flap, therefore, forms a smooth lining for the currency pocket. The attachment structure permits use of a billfold of dimensions substantially equal to the dimensions of one-half of wallet 12. Prior approaches employing a separate compartment have necessitated a downsized billfold or an oversized wallet. The present invention maintains the aesthetics and dimensions of more conventional wallets and billfolds. Access to the compartments of the billfold is not blocked. The billfold may be easily secured to and easily removed from the main wallet. The wallet and billfold are readily manufactured from flexible, foldable materials such as leather or certain vinyls. The components are easily assembled.

When a coat is not worn or a purse not carried, the user can separate billfold 14 from the main wallet. Currency within pocket 56 is easily carried. Credit cards which might be needed are readily positioned within the pockets defined by the billfold. The billfold may then be used in a conventional fashion.

Figure 7:
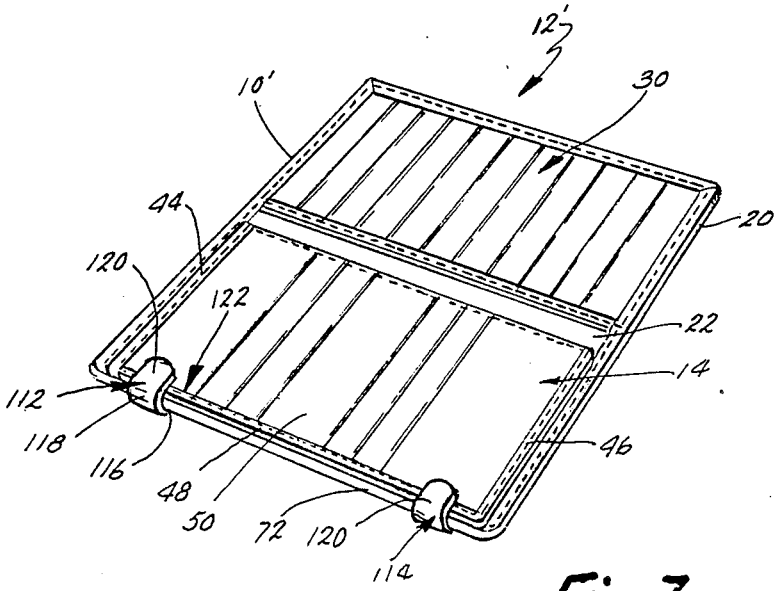
FIG. 7 is a perspective view of an alternative embodiment in accordance with the present invention.
Figure 8:
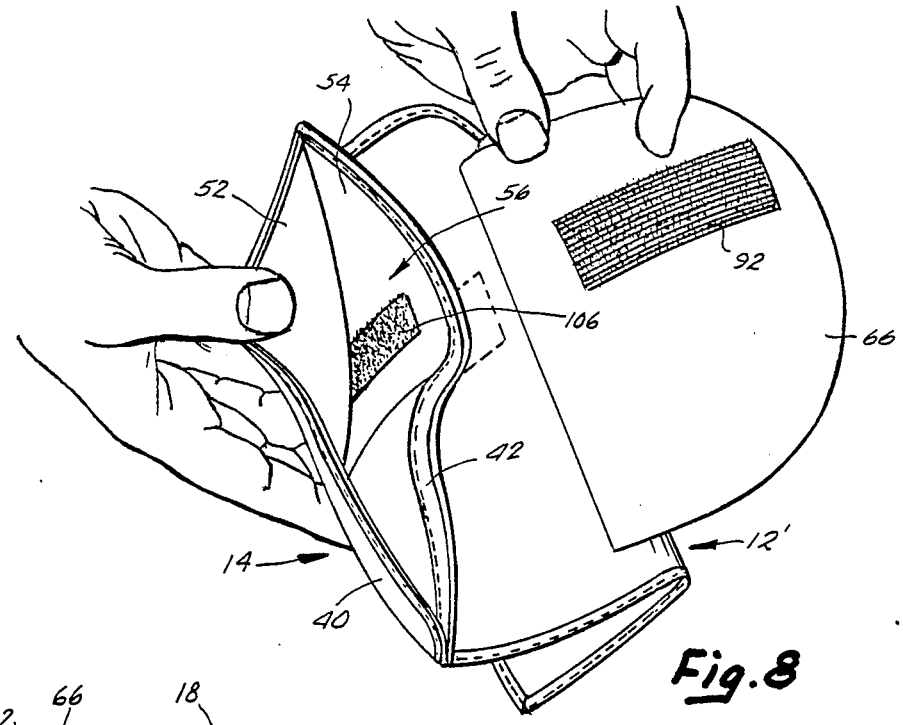
FIG. 8 is a perspective view of the alternative embodiment showing the inner, opposed surfaces of the billfold and one of the securing flaps.
Figure 9:
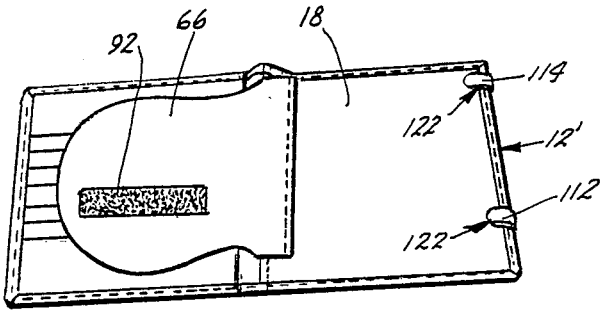
FIG. 9 is a perspective view of the alternative embodiment with the billfold removed.

A device 10' with another alternative billfold attached means is illustrated in FIGS. 7, 8 and 9. Instead of the elongated, generally U-shaped strap 78 of the embodiment of FIGS. 1–6, device 10' includes a pair of generally U-shaped prongs or short straps 112, 114. Prongs 112, 114 are secured to the reinforcement strip 74 at spaced positions along the lateral or outer edge 72 of member 18 of wallet 12'. The prongs are formed from plastic boning material. The elements include a leg 116 secured to the reinforcement strip, a base 118 and another leg 120. Each element 112, 114, therefore, defines a pocket 122. As shown in FIG. 7, pocket 122 is dimensioned to receive billfold 14 at its bottom edge. As shown in FIG. 8, wallet 12' also includes a flap 66 having a strip of hook or loop fastening material 92 secured thereto. Flap 66 is readily folded into currency pocket 56 of billfold 14, strip 92 interlocks with material strip 106, as in the prior embodiment. Billfold 14 is, therefore, securely retained on wallet 12 by flap 66, fastener strips 92, 106 and prongs 112, 114.

In view of the foregoing description, one of ordinary skill in the art may envision various modification which would not depart from the inventive concepts disclosed herein. Other billfold attachment means might be used while still obtaining the benefits of ready access to the compartments of the billfold, the pockets and the like. For example, wallet 12 could be formed with corner gussets which would receive corners of the billfold. These would function in a manner very similar to the prongs 112, 114. They would, however, cover a portion of the outer surface of the billfold and might necessitate slightly smaller dimensions for the billfold. Also, external fasteners could be used to secure the billfold to the wallet. While providing many of the advantages disclosed herein, such would result in exposed fasteners on the billfold outer member which could catch in the users pocket and/or detract from the appearance of the device. Such fasteners are, therefore, not preferred.

The above description should be considered as only that of the preferred embodiments. The true spirit and scope of the present invention may be determined by reference to the appended claims.

The embodiments of the invention in which an exclusive property or privilege is claimed are defined as follows:

1. A combination wallet and billfold, comprising:

a pair of foldable, generally rectangular wallet members joined together around their peripheries, said wallet members defining an outer surface, an inner surface, and a vertical fold line separating the wallet members into halves;

pocket means on an inner surface of one of said halves for defining a plurality of pockets for cards;

a billfold having inner and outer rectangular billfold members joined along three sides thereof to define an inner surface, an outer surface and an elongated currency pocket having a pair of opposed surfaces, said billfold having a peripheral dimension substantially equal to the peripheral dimension of the other of said halves of said wallet members; and billfold attachment means on at least one of said wallet members for attaching said billfold to said other of said halves along an edge of the billfold and within said currency pocket to that the inner surface of said billfold is exposed when the wallet is opened and the currency pocket can be opened without separating the billfold from the wallet members, said billfold attachment means including means on one of said wallet members for securing the billfold thereto at said edge and a flap joined to one of said wallet members, said flap dimensioned to extend into said currency pocket.

2. A combination wallet and billfold as defined by claim 1 wherein said billfold attachment means comprises:

a pair of spaced, generally L-shaped prongs joined to an edge of said other of said halves, said prongs each dimensioned to define a pocket to receive a bottom edge of said billfold.

3. A combination wallet and billfold as defined by claim 2 wherein said flap is joined to at least one of said wallet members adjacent said fold line.

4. A combination wallet and billfold as defined by claim 3 wherein said billfold attachment means further includes fastening means on said flap for fastening said flap to one of the opposed surfaces of said currency pocket.

5. A combination wallet and billfold, comprising:

a pair of foldable, generally rectangular wallet members joined together around their peripheries, said wallet members defining an outer surface, an inner surface, and a vertical fold line separating the wallet members into halves;

pocket means on an inner surface of one of said halves for defining a plurality of pockets for cards;

a billfold having inner and outer rectangular billfold members joined along three sides thereof to define an inner surface, an outer surface and an elongated currency pocket having a pair of opposed surfaces, said billfold having a peripheral dimension substantially equal to the peripheral dimension of the other of said halves of said wallet members; and billfold attachment means on at least one of said wallet members for attaching said billfold to said other of said halves along an edge of the billfold and within said currency pocket so that the inner surface of said billfold is exposed when the wallet is opened and the currency pocket can be opened without separating the billfold from the wallet members, said billfold attachment means comprising:

a first strap joined to and extending from a side of one of said joined wallet members and towards the fold line; and a second strap joined to at least one of said wallet members adjacent said fold line, said billfold defining an opening in a bottom edge thereof, said first strap dimensioned to extend through said opening and into said currency pocket, said second strap dimensioned to extend into said elongated currency pocket of said billfold.

6. A combination wallet and billfold as defined by claim 5 further including:

fastener means on said straps for fastening said straps together so that said billfold is secured to one of said wallet members and the inner surface of the billfold may be grasped for easy access to the currency pocket.

7. A combination wallet and billfold as defined by claim 5 further including a reinforcement strip joined to one of said wallet members adjacent said fold line.

8. A combination wallet and billfold as defined by claim 6 further including a reinforcement strip joined to said wallet member adjacent said side of one of said joined wallet members, said first strap extending from said reinforcement strip.

9. A combination wallet and billfold as defined by claim 5 wherein said second strap is an elongated flap-like member dimensioned to cover a substantial portion of an inner surface of said currency pocket.

10. A combination wallet and billfold as defined by claim 8 wherein said first strap is a generally U-shaped member having a leg joined to said reinforcement strip by said wallet member and an elongated leg extending towards said fold line.

11. A combination wallet and billfold as defined by claim 10 wherein said first strap is formed from a semi rigid material.

12. A combination wallet and billfold as defined by claim 11 wherein said second strap is an elongated flap-like member dimensioned to cover a substantial portion of an inner surface of said currency pocket.

13. A combination wallet and billfold as defined by claim 11 wherein said fastener means comprises a hook and loop fastener having a hook portion on one of said first and second straps and a loop portion on the other of said first and second straps.

14. A combination wallet and billfold as defined by claim 12 wherein said fastener means comprises:

a hook and loop fastener having a hook portion on one of said first and second straps and a loop portion on the other of said first and second straps.

15. An article for carrying currency, said article comprising:

a wallet having an inner surface separated into halves by a fold line;

a billfold having an inner surface, an outer surface, lateral edges and a bottom edge, said billfold defining a currency pocket and being dimensioned to be covered by a half of said wallet when the wallet is folded to a closed position with the halves thereof facing each other; and billfold attachment means on said wallet and said billfold for removably yet securely attaching the billfold to said wallet with the bottom edge of the billfold being adjacent a lateral edge of the wallet and with the inner surface of the billfold exposed when the wallet is opened, said billfold attachment means including means joined at an edge of the wallet for securing the billfold to said wallet along the bottom edge of the billfold and a member joined to said wallet dimensioned to extend into said currency pocket.

16. An article as defined by claim 15 wherein said attachment means comprises:

at least one prong attached to a lateral edge of said wallet, said prong defining a pocket dimensioned to receive said billfold;

a flap joined to said wallet adjacent said fold line, said flap dimensioned to be received within said currency pocket of said billfold; and fastener means securing said flap to a surface of the billfold within the currency pocket.

17. An article as defined by claim 16 wherein said fastener means further includes a fastener on an inner surface of the currency pocket and engaging said flap.

18. An article ad defined by claim 16 wherein said flap has a generally semi-circular configuration and covers a substantial portion of the inner surface of the currency pocket.

19. An article as defined by claim 17 wherein said flap has a generally semi-circular configuration and covers a substantial portion of the inner surface of the currency pocket.

20. An article for carrying currency, said article comprising:

a wallet having an inner surface separated into halves by a fold line;

a billfold having an inner surface, an outer surface, lateral edges and a bottom edge, said billfold defining a currency pocket and being dimensioned to be covered by a half of said wallet when the wallet is folded to a closed position with the halves thereof facing each other; and billfold attachment means on said wallet and said billfold for removably yet securely attaching the billfold to said wallet with the bottom edge of the billfold being adjacent a lateral edge of the wallet and with the inner surface of the billfold exposed when the wallet is opened, said attachment means comprising:

a generally rigid strap extending from the lateral edge of the wallet, said billfold defining an opening in the bottom edge, said rigid strap dimensioned to extend through said opening and into said currency pocket, and a flexible flap secured to the inner surface of said wallet adjacent said fold line, said flap dimensioned to be folded into said currency pocket.

21. An article as defined by claim 20 further including:

fastener means on said flap and strap for securing said flap and said strap together.

22. An article as defined by claim 21 wherein said fastener means comprises a hook and loop fastener.

* * * * *

UNITED STATES PATENT AND TRADEMARK OFFICE

CERTIFICATE OF CORRECTION

PATENT NO. : 4,966,210

DATED : October 30, 1990

INVENTOR(S) : John M. Folkertsma

It is certified that error appears in the above-identified patent and that said Letters Patent is hereby corrected as shown below:

Column 1, line 33;

"can the" should be --can then--.

Column 1, line 64;

"surface" should be --surfaces--.

Column 3, line 37;

"68" should be --68'--.

Column 3, line 43;

Before "reinforcement" insert --a--.

Column 4, lines 39 and 40;

"attached" should be --attachment--.

Column 5, line 34;

"to that" should be --so that--.

Column 7, line 33, claim 18;

"ad defined" should be --as defined--.

Signed and Sealed this

Thirty-first Day of March, 1992

*Attest:*

HARRY F. MANBECK, JR.

*Attesting Officer*

*Commissioner of Patents and Trademarks*